US006948378B2

(12) United States Patent
Solberg et al.

(10) Patent No.: US 6,948,378 B2
(45) Date of Patent: Sep. 27, 2005

(54) METHOD AND APPARATUS FOR MEASURING TENSION IN A MOVING WEB

(75) Inventors: Bruce Jerome Solberg, Green Bay, WI (US); David Kent Mattheis, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/461,580

(22) Filed: Jun. 13, 2003

(65) Prior Publication Data

US 2004/0250628 A1 Dec. 16, 2004

(51) Int. Cl.[7] ..... G01N 3/08
(52) U.S. Cl. ..... 73/828
(58) Field of Search ..... 73/862.41, 862.451, 73/159, 862.391, 828, 800, 144, 862.454, 862.474; 250/559.32, 559.29; 242/421.6; 702/42

(56) References Cited

U.S. PATENT DOCUMENTS 3,201,985 A 8/1965 Williams
3,845,434 A 10/1974 Carter
3,861,207 A * 1/1975 Barbee ..... 73/862.07
3,950,988 A 4/1976 Nowisch et al.
4,043,495 A 8/1977 Sander
4,109,520 A 8/1978 Eriksson
4,335,603 A * 6/1982 Locke ..... 73/159
4,492,328 A 1/1985 Munnich et al.
4,655,093 A * 4/1987 Strom et al. ..... 73/862.41
4,842,177 A 6/1989 Callender et al.
5,020,381 A 6/1991 Bartlett
5,052,233 A * 10/1991 Rantala ..... 73/862.45
5,092,059 A 3/1992 Wimberger et al.
5,357,812 A 10/1994 Kubert et al.
5,370,289 A 12/1994 Helms
5,452,834 A 9/1995 Mariotti et al.
5,480,085 A 1/1996 Smithe et al.
5,520,317 A 5/1996 Eckert et al.
5,558,263 A 9/1996 Long
5,671,895 A 9/1997 Cederholm et al.
5,709,389 A 1/1998 Algers et al.
5,775,623 A 7/1998 Long
5,837,910 A 11/1998 Beijbom et al.
5,891,309 A 4/1999 Page et al.
5,967,457 A 10/1999 Wildenberg et al.
5,979,731 A 11/1999 Long et al.
6,004,432 A 12/1999 Page et al.
6,030,496 A 2/2000 Baggot et al.
6,325,896 B1 12/2001 Hultcrantz et al.
6,374,247 B1 4/2002 Gebauer
6,397,495 B1 6/2002 Doherty et al.
6,481,275 B1 * 11/2002 Koivukunnas et al. ..... 73/159
6,813,941 B2 * 11/2004 Beuther et al. ..... 73/159

* cited by examiner

*Primary Examiner*—Max Noori
*Assistant Examiner*—Octavia Davis
(74) *Attorney, Agent, or Firm*—Peter D. Meyer; David K. Mattheis; David M. Weirich

(57) ABSTRACT

An apparatus and method for the non-contact measurement of tension in a moving web material are provided herein. In one embodiment the apparatus includes a non-contacting tension-sensing element, such as an airfoil, disposed transverse to the machine direction of the web material at least one sensor capable of detecting a reaction of the non-contacting tension-sensing element to changes in the tension of the moving web material and a data processing system capable of determining a web tension analog value that is proportional to the tension of the web material.

15 Claims, 1 Drawing Sheet

METHOD AND APPARATUS FOR MEASURING TENSION IN A MOVING WEB

FIELD OF THE INVENTION

This invention relates to the measurement of web tension in a moving web. More particularly, the invention relates to non-contact methods of measuring tension in a moving web.

BACKGROUND OF THE INVENTION

Web materials, generally planar materials having a thickness much smaller than the dimensions of the plane of the material are well known. Examples of web materials include metal foils, celluloid films, magnetic tapes, and paper products including hard grades of paper as well as tissue papers.

Handling web materials, and particularly handling lightweight and fragile web materials, without damaging the materials is facilitated by controlling the speed of the web handling machinery according to the tension of the web material. The machinery speed is adjusted to maintain the web tension at a value below the tension at which the web will break or be damaged. These control methods require the measurement of the web tension or of a value analogous to the web tension as a source of feedback for the machine controls.

Previously, tension has been measured with the use of an instrumented idler roller that is wrapped by the web material. These rollers can be problematic in that the roller has a mass therefore an inertial impulse force is necessary to start the roller moving. Once moving, the roller has inertia that must be overcome to slow or stop the roller as the web slows or stops. The impulse force and roller inertial forces can be sufficient to damage or break the web. Therefore, a method of measuring web tension without contacting the web is desired.

Previous non-contact methods detect local changes in the pressure of an air column that is coupled to the boundary air between the web material and a curved surface. These methods can be adversely affected by dust in the measurement area and may not be effective at very low tension levels associated with the handling of lightweight paper webs such as paper towels, and bath tissues, since the local changes in the boundary air layer associated with the changes in the low tension levels of such webs are small.

SUMMARY OF THE INVENTION

An apparatus for non-contact measurement of the tension of a moving web material, and a method for the use of the apparatus are disclosed herein. In one embodiment the apparatus comprises a non-contacting tension-sensing element, such as an airfoil, disposed in the cross-machine direction of the web material. The tension sensing element is considered a non-contacting element because the tension of the web is sensed without the necessity of contacting the web with the tension sensing element. The apparatus further comprises at least one sensor capable of detecting the reaction of the non-contacting tension-sensing element to changes in the tension of the moving web.

In one embodiment the method comprises steps of providing a non-contacting tension-sensing element, such as an airfoil routing the moving web around the non-contacting tension-sensing element, detecting a reaction of the non-contacting tension-sensing element to changes in the tension of the moving web, and determining a web tension analog value according to the detected reaction.

BRIEF DESCRIPTION OF THE DRAWING

The FIGURE is a schematic side view of an embodiment of the apparatus according to the present invention

DETAILED DESCRIPTION OF THE INVENTION

Figure 1:
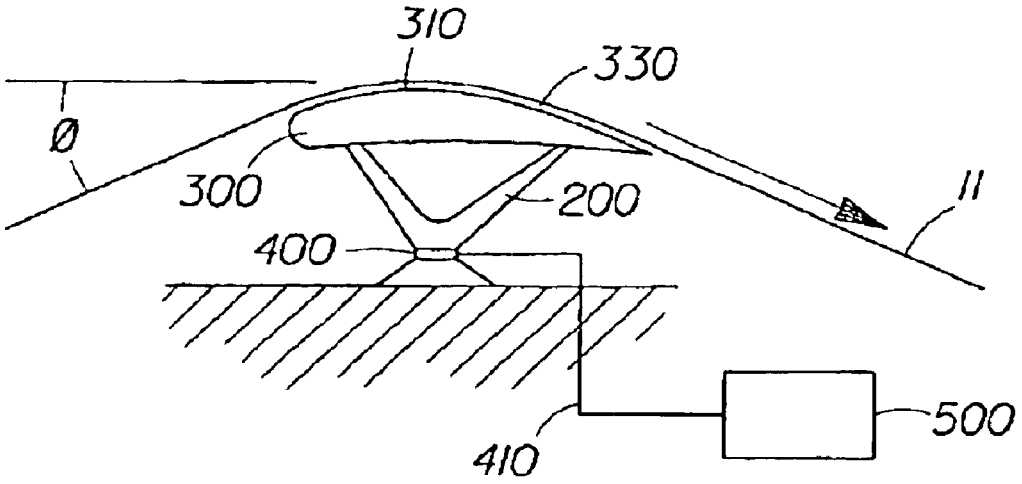

As shown in the FIGURE, the web 11 is routed around a non-contact tension-sensing element, such as an airfoil 300. The tension-sensing element is disposed transverse to the machine direction of the web 11. The machine direction of the web 11 is the direction parallel to the path of the web 11 through the processing machinery. The cross-machine direction of the web 11 is the direction perpendicular to the machine direction. The tension-sensing element preferably extends at least across the full width of the web 11. As the web 11 moves in the machine direction past the tension-sensing element, the forces working on the tension-sensing element fluctuate. Such fluctuations in force on the tension-sensing element are detectable as a reaction of the tension-sensing element. The tension-sensing element reacts to the motion of the web 11. The reaction of the tension-sensing element varies according to changes in the tension of the web 11. As shown in the FIGURE, the airfoil 300 comprises a web-facing surface 310, which is curved in the machine direction of the web. The web 11 is routed around the airfoil 300, and wraps at least a portion of the airfoil 300 at a wrap angle θ. The wrap angle must be greater than 0° for the airfoil 300 to react to the web 11. The maximum wrap angle is determined by the capability of the moving web 11 to generate an aerodynamic lift force as the web 11 moves past the airfoil 300. If sufficient lift force is not generated, the web 11 will remain in contact with the airfoil 300. Wrap angles in excess of 90° are possible. In one embodiment, the wrap angle θ of the web 11 can be from about 5° to about 60°. In another embodiment, the wrap angle θ can be from about 10° to about 45°. In another embodiment, the wrap angle θ can be from about 15° to about 35°. Wrap angles greater than 35° are less desirable due to an increased likelihood of a stall condition wherein a sudden loss of a substantial portion of the aerodynamic lift force occurs. Wrap angles less than 5° do not provide sufficient lift force to create a detectable reaction in the airfoil 300.

A boundary layer of air 330 in proximity to the moving web 11 moves with the web 11 in the machine direction. The boundary layer of air 330 interacts with the web-facing surface 310 of the airfoil 300 generating an aerodynamic lift force that lifts the web 11 away from the airfoil 300. When the motion of the web 11 creates sufficient lift force to lift the web 11 away from the airfoil 300, the web 11 moves in the machine direction and wraps the airfoil 300 but does not contact the airfoil 300.

As the web 11 is unwound, respective portions of the length of the web 11 pass sequentially by the airfoil 300. The tension of the respective portions of the web 11 can vary throughout the roll of web material (not shown). The variation in web tension is reflected in lift force changes to the airfoil 300 as translated to the airfoil 300 via the boundary air layer 330. Without being bound by theory, Applicants believe that the airfoil 300 is coupled to the web 11 by the boundary layer of air 330 between the web 11 and the airfoil 300. As web portions of varying tension pass the airfoil 300, the airfoil 300 reacts to changes in the web tension via the boundary layer of air 330, which influences the lift forces impacting the airfoil 300. The reaction of the airfoil 300 is proportional to the changes in the tension of the web 11. One or more sensors 400 are capable of detecting the reaction of the airfoil 300 to the lift force changes. The tension of the web 11 can be measured without contacting the web 11 by processing the output of one or more sensors 400 capable of detecting the reaction of the airfoil 300 to the changes in the tension of the web 11. The airfoil 300 is coupled to the sensor 400 by mounting element 200. The sensor or sensors can detect the reaction of the airfoil 300 to the entire width of the web 11. It is possible to detect the tension in lightweight tissue webs moving with relatively low levels of web tension since the sensor is indirectly detecting the aggregate tension of the web rather than a localized web tension via the lift force changes acting on the airfoil 300.

In one embodiment the airfoil 300 comprises a static airfoil. A static airfoil reacts to the web tension changes as described above. At low web speeds, (less than 1100 ft/min [335 m/min]) a tissue paper web does not create sufficient lift forces to move the web 11 from contact with the airfoil 300. At these speeds, the web 11 is in contact with the airfoil 300 and a drag force of about 3 lbs (13.34 N) is generated between the web 11 with a width of about 101 inches (2.56 m) and the airfoil 300. At production speeds in excess of 1100 feet/min (335 m/min), there is a drag force generated between the web 11 and the airfoil 300 of around 1.75 lbs (7.784 N) for a web with a 101-inch (2.56 m) width, at a wrap angle of 45° to 60°.

In an alternative embodiment the airfoil 300 comprises an active airfoil. An exemplary active airfoil is the active PathMaster™ available from MEGTEC Systems, of DePere Wis. The active airfoil provides a supplemental source of air to augment the boundary layer of air 330 moving with the web 11. The use of an active airfoil can offset the drag force generated between the web 11 and the airfoil 300 that is present when the static foil is used. The active airfoil reacts to changes in the tension of the web 11 as described above.

In yet another embodiment, the airfoil 300 comprises a circular foil or air bar and provides the additional function of altering the path of the web 11. This airfoil 300 may be used to reorient the web 11 more than 90° from a first direction to a second direction This embodiment may be used to achieve desired web routing as the web 11 is unwound from the roll (not shown).

The sensor 400 can be selected to sense any reaction of the airfoil 300 to the changes in the tension of web 11. Exemplary sensors include, but are not limited to, accelerometers, velocimeters, displacement sensors, strain gauges and load cells. An exemplary accelerometer in the model 797A accelerometer available from Wilkoxon Research Inc., of Gaithersburg, Md. An exemplary velocimeter is the model 797V velocimeter available from Wilkoxon Research Inc., of Gaithersburg, Md. The model 797A or Model 797V may also be used as displacement sensors by appropriately processing the sensor output. An exemplary load cell is the PressDuctor™ mini PTFL301E available from ABB USA, Norwalk, Conn. The following discussion of the use of the sensor 400 is in terms of a single sensor 400 although the invention is not limited to the use of a single sensor.

The sensor 400 has a principle axis along which axis the sensor can detect changes to the airfoil 300. The angle between the web 11 and the principle axis determines the proportion of the web tension that acts upon the airfoil 300 in a detectable manner. This angle is determined by the wrap angle θ of the web 11 and the geometry of the installed sensor 400.

The exemplary load cell described above requires the use of a low-lateral-force floating mount system for the airfoil 300. The load cell may not respond accurately when forces off the principle axis of the load cell act upon it. The axis of the cell may be oriented in the machine direction of the web 11, alternatively the axis of the load cell may be oriented at an angle to the machine and cross-machine directions of the web material path. The deflection of the airfoil 300 in the cross machine direction due to the weight of the airfoil 300 may produce off-axis loading of the load cell. The low-lateral-force floating mounting system compensates for cross-machine direction deflections and reduces the off-axis loading of the load cell. Mounting the airfoil 300 on gimbals provides a low-lateral-force floating mount. The gimbals in the mounting system provide pivot points for the mounting brackets of the airfoil 300 on the axis of the load cell. The deflection of th airfoil 300 in the cross machine direction causes the mounting clamps to pivot on the gimbals without the corresponding deflection forces being transferred to, and detected by, the load cell.

The output of the sensor 400 can be transmitted to a data processing system 500 via a communication link 410. The communication link 410 may be of any form that will satisfactorily transmit the output signal from the sensor 400 to the data processing system 500. Exemplary communication links 410 include without limitation, wireless links such as the BlueLynx™ wireless link available from Wilcoxon research, Gaithersburg, Md., or hard wiring between the sensor and the data processing system 500. The communication link 410 may provide for the transmission of the output of a single sensor 400 in an analog or digital format, or may provide for the multiplexed transmission of the outputs of multiple sensors 400.

The data processing system 500 determines a web tension analog value according to the reaction of the airfoil 300 to changes in tension in the moving web 11 that are sensed by the sensor 400. The web tension analog value is so named because the value is analogous to the web tension. The web tension analog value may be generated as either an analog or digital signal. The web tension analog value determied by the data processing system 500 can be the actual tension of the web 11. Alternatively, the web tension analog value can be directly proportional to the actual web tension, and offset from the actual web tension value. Either form of the web-tension analog value described above may be used to control the web handling process. An exemplary data processing system s the ABB PFEA111, available from ABB USA, Norwalk, Conn.

The output of the sensor 400 may be provided to the data processing system 500 as a signal varying in voltage, or current. The data processing system 500 may be configured to detect the changes in the sensor 400 output and to determine a web tension analog value according to those changes. The algorithm of the data processing system 500 will depend upon the type of sensor 400 and the specific details of the sensor model as well as the wrap angle θ of the web 11 and the orientation of the sensor's principle axis.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for measuring tension in a moving web, the method comprising steps of:

a) providing a non-contacting tension-sensing element supported by a low lateral force mount, b) routing the moving web around the non-contacting tension-sensing element at a wrap angle, c) detecting a reaction of the non-contacting tension-sensing element to the moving web, and d) determining a web tension analog value according to the detected reaction, wherein the non-contacting tension-sensing element comprises an airfoil.

2. The method according to claim 1 wherein the step of measuring a reaction of the non-contacting tension-sensing element to the moving web comprises measuring a force on the non-contacting tension-sensing element.

3. The method according to claim 1 wherein the step of measuring a reaction of the non-contacting tension-sensing element to the moving web comprises measuring a displacement of the non-contacting tension-sensing element.

4. The method according to claim 1 wherein the step of measuring a reaction of the non-contacting tension-sensing element to the moving web comprises measuring an acceleration of the non-contacting tension-sensing element.

5. The method according to claim 1 wherein the step of measuring a reaction of the non-contacting tension-sensing element to the moving web comprises measuring a velocity of the non-contacting tension-sensing element.

6. The method according to claim 1 wherein the wrap angle is from about 5° to about 60°.

7. The method according to claim 1 wherein the airfoil comprises providing an active air foil.

8. A method of measuring tension in a moving web comprising:

a) providing a non-contacting tension-sensing element comprising an active airfoil, b) supporting the non-contacting tension-sensing element on a low lateral force mount, c) routing the moving web around the non-contacting tension-sensing element at a wrap angle, d) detecting the reaction of the non-contacting tension-sensing element to the moving web, and e) determining a web tension analog value according to the detected reaction.

9. An apparatus for measuring the tension in a moving web, the apparatus comprising:

an non-contacting tension-sensing element comprising an active airfoil positioned across the machine direction of the web supported by a low lateral force mount, a sensor capable of measuring the reaction of the non-contacting tension-sensing element to the moving web, a data processing system capable of determining a web tension analog according to an output of the sensor, and a communication link between the sensor and the data processing system.

10. The apparatus according to claim 9 wherein the sensor comprises a force sensor.

11. The apparatus according to claim 9 wherein the sensor comprises a displacement sensor.

12. The apparatus according to claim 9 wherein the sensor comprises an acceleration sensor.

13. The apparatus according to claim 9 wherein the sensor comprises a velocity sensor.

14. The apparatus according to claim 9 wherein the web wraps the non-contacting tension-sensing element from about 5° to about 60°.

15. The apparatus according to claim 9 comprising a plurality of sensors.

* * * * *